US005651908A

United States Patent [19]

Mansfield

[11] Patent Number: 5,651,908

[45] Date of Patent: Jul. 29, 1997

[54] FLUID CONTAINERS HAVING STORAGE LOCATION FOR A DISCHARGE END OF AN ATTACHED FLEXIBLE HOSE

[75] Inventor: Andrew Charles Mansfield, Ware, England

[73] Assignee: Pan Britannica Industries Limited, Hertfordshire, England

[21] Appl. No.: 379,498

[22] PCT Filed: Aug. 6, 1993

[86] PCT No.: PCT/GB93/01677

§ 371 Date: May 15, 1995

§ 102(e) Date: May 15, 1995

[87] PCT Pub. No.: WO94/03278

PCT Pub. Date: Feb. 17, 1994

[30] Foreign Application Priority Data

Aug. 8, 1992 [GB] United Kingdom ..... 9216889

[51] Int. Cl.[6] ..... B05B 15/06

[52] U.S. Cl. ..... 222/530; 222/383.3; 222/538

[58] Field of Search ..... 222/530, 538, 222/534, 383.3, 401, 402; 239/373

[56] References Cited

U.S. PATENT DOCUMENTS

| | | | |
|---|---|---|---|
| 1,277,636 | 9/1918 | Parks | 222/538 X |
| 3,134,519 | 5/1964 | Tidd | 222/530 X |
| 4,192,464 | 3/1980 | Chow . | |
| 4,318,403 | 3/1982 | Sneider | 222/538 X |
| 4,416,396 | 11/1983 | Ward | 222/530 X |
| 4,650,100 | 3/1987 | Echazabal, Jr. | 222/530 X |
| 4,805,814 | 2/1989 | Allen, Sr. | 222/538 |
| 5,143,263 | 9/1992 | Newell | 222/538 |

FOREIGN PATENT DOCUMENTS

| | | | |
|---|---|---|---|
| 611488 | 8/1933 | Germany | 222/530 |
| 2909449 | 9/1980 | Germany | 222/530 |
| 963912 | 7/1964 | United Kingdom . | |

OTHER PUBLICATIONS

International Search Report, dated Dec. 3, 1993, Appl. No. PCT/GB93/01677.

*Primary Examiner*—Kevin P. Shaver
*Attorney, Agent, or Firm*—Loeb & Loeb LLP

[57] ABSTRACT

A container composed of a body in which fluid to be dispensed can be stored. The body has a fluid outlet at an upper part to which one end of a flexible hose is attached. An opposite, discharge, end of the hose has a spray lance attached to it. An attachment device, such as a tube, is retained by latch elements in an external recess in a side wall of the body to retain the discharge end of the hose releasably to the body when the container is not in use. The container may be used to discharge liquids such as fertilizers, pesticides or other chemical agents in the form of a spray.

4 Claims, 1 Drawing Sheet

FLUID CONTAINERS HAVING STORAGE LOCATION FOR A DISCHARGE END OF AN ATTACHED FLEXIBLE HOSE

BACKGROUND OF THE INVENTION

This invention relates to fluid containers and in particular to fluid containers having a flexible hose through which fluid is discharged.

Known fluid, or more particularly liquid, containers of this kind generally have an outlet at their upper region from which a supply of fluid can be taken. The outlet may also be used as a means of refilling the container with fluid. A hose is connected to the outlet for the discharge of fluid from the container. A spray lance may be attached to a discharge end of the hose and may comprise a nozzle attached to a body. Pumping means to move the fluid from the container to the spray lance through the hose may be provided either in relation to the container or the lance.

A disadvantage of this kind of container is that when it is stored, left for a short time, or carried, the hose, and if provided the lance, may hang or extend freely from the container and may become damaged or entangled. It is known from U.S. Pat. No. 4,192,464 to provide a slotted tube on a wall of the container to carry the lance when not in use, but this still leaves the lance protruding and exposed to damage.

SUMMARY OF THE INVENTION

According to the present invention there is provided a container adapted to dispense fluid comprising a body in which fluid to be dispensed can be stored, a fluid outlet at an upper part of the body, and a flexible hose connectable at one end to the fluid outlet and having an opposite discharge end, and attachment means retained by latch means in an external recess of a side wall of the body and adapted to retain the discharge end of the hose releasably in a recess in a wall of the body when the container is not in use.

The attachment means may co-operate directly with the discharge end of the hose to retain the discharge end to the body. Preferably the discharge end has a lance attached thereto and the attachment means co-operates with the lance to retain the discharge end to the body. The attachment means may include an item formed separately from the body which is retained in the recess by the latch means provided on the body. In one convenient form the attachment means comprises a holster or tube retained in the recess to receive the discharge end of the hose or the lance. The holster or tube may be permanently fixed to the body.

Preferably the attachment means is a tube which locates a spray lance connected to the hose. The lance may have a member which is a sliding fit in the tube. The tube may be provided with a slot running along its length thus enabling the lance to be clipped directly into the tube.

Preferably the container is adapted to dispense liquid as a spray. The liquid may, for example, be a fertilizer, pesticide or other chemical agent used in agriculture, horticulture, or domestic, industrial or amenity usage.

BRIEF DESCRIPTION OF THE DRAWING

A container embodying the invention will now be described by way of example only with reference to the accompanying drawings of which.

DESCRIPTION OF THE PREFERRED EMBODIMENT

Figure 1:
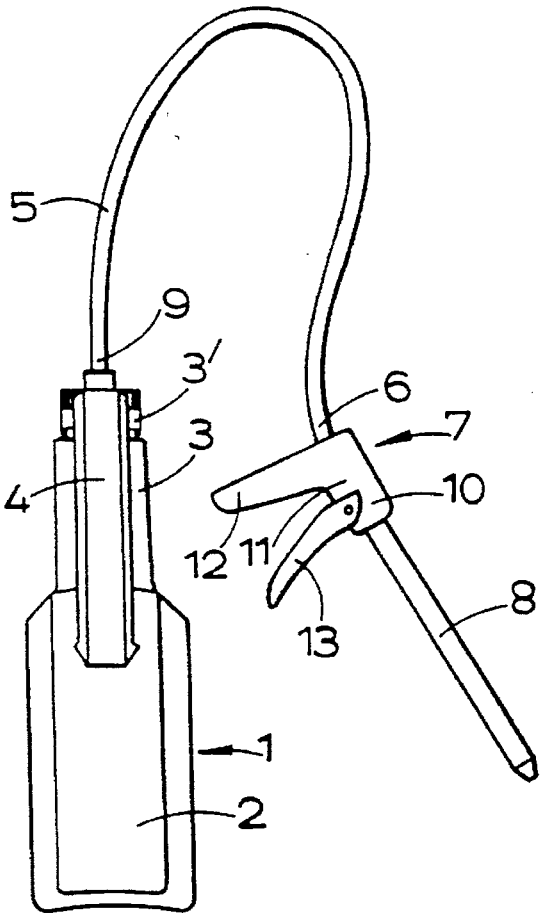
FIG. 1 is a rear view of the container.

The container 1 shown in the accompanying drawings is in the form of a spray dispenser and has a generally rectangular body part 2 in which liquid to be dispensed is stored and from which integrally extends upwardly a neck 3 and a handle 4. At the top of the neck 3 there is an outlet 3'. A flexible hose 5 is attached at one end to the outlet 3' by a connector 9 which is screw-threadedly connected to the outlet. An opposite, discharge end 6 of the hose 5 has a spray lance 7 attached to it.

The body part 2, neck 3 and handle 4 of the container are combined in a unitary molding made from a suitably durable plastics material which additionally is resistant to a wide range of chemicals, including for example nitrate based fertilizers or solvents. Polyethylene is a suitable material whether by itself or co-extruded with other polymers.

The spray lance 7 consists of a body portion 10 comprising a central part 11 and a handle 12. A trigger 13 is pivoted to the central part 11 and repetitive movements of the trigger towards the handle cause a pump (not shown) in the central part to draw liquid from the body part 2 through the hose 5 and to drive the liquid through a delivery nozzle 8 which extends from the body portion 10.

A recess 14 is molded externally into a side wall of the body part 2 of the container. The recess 14, which extends vertically when the container is upright as shown in the drawings, is U-shaped in cross-section and is sunken into the side wall of the body part 2. Four clips 15, 16 integrally formed with the side wall are arranged in pairs along the recess 14, two clips 15 at its upper end and two clips 16 at its lower end. The clips 15, 16 of each pair are directed towards one another and partially overlie the recess.

A metal or plastics tube 17 is located longitudinally in the recess 14 and is of a size and shape such that its outer surface corresponds with and fits against the inner semi-circular surface of the recess. The clips 15 and 16 overlap and bear on the tube 17 such that the tube is fixed against movement in the recess.

The container 1 is a hand held portable dispenser such as may be used for spraying liquids used in agriculture and/or horticulture or domestic, industrial or amenity usage. A user carries the container in one hand by its handle 4. The body part 2 may be, say, of three-liter capacity and contain fertilizer or pesticide in a diluted form. The user holds the spray lance 7 in his other hand. By squeezing on the trigger 13 the liquid is delivered through the nozzle 8 in a spray.

The hose may possibly be disconnected from the outlet 3' and a screw cap, not shown, fitted instead to close off the outlet. A similar dispenser filled with liquid and closed by a screw cap, without the hose and spray lance, may be supplied as a replacement for an emptied container and be fitted with the hose and spray lance of the latter.

Figure 2:
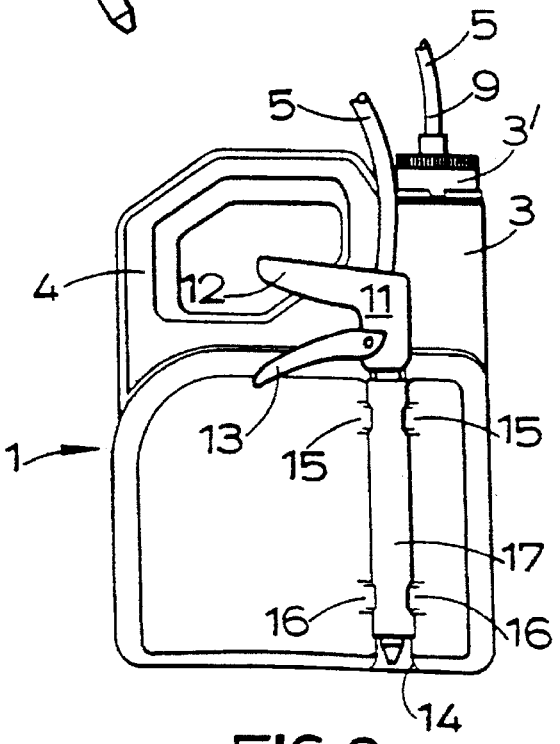
FIG. 2 is a side view of the container showing a lance retained within attachment means of the container.
Figure 3:
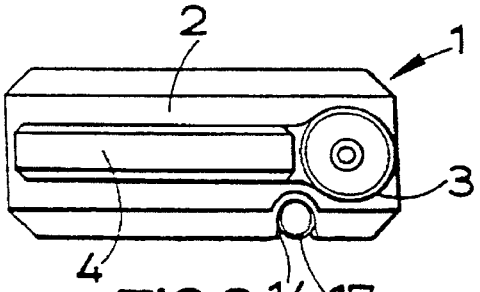
FIG. 3 is a plan view of the container.

The nozzle 8 of the spray lance 7 can fit into the tube 17 as a sliding fit as shown in FIG. 2. In this way the lance 7 can be stowed away in the tube and retained while the container is not in use, for example if it is stored or while the container is being carried. Therefore the lance 7 and hose 5 are kept out of harm's way and less likely to be damaged or become entangled with one another and/or with other articles or people.

I claim:

1. A container for dispensing fluid, the container comprising:

a body for storing fluid to be dispensed, the body having an upper part, a fluid outlet at the upper part, a side wall provided with an elongate external recess having a length dimension that is directed toward the upper part, and latch means adjacent the recess; attachment means formed separately from the body and retained in the recess by the latch means; and a flexible hose having a first end connected to the fluid outlet and a discharge end, remote from the first end, releasably located by the attachment means so as to extend along the length dimension of the recess.

2. A container according to claim 1, wherein the discharge end of the flexible hose comprises a lance and the attachment means comprises a holster or tube which extends longitudinally of the recess, is engaged by the latch means to be retained thereby in the recess, and receives the lance.

3. A container according to claim 1, wherein the attachment means comprises a holster or tube with extends longitudinally of the recess, is engaged by the latch means to be retained thereby in the recess, and receives the discharge end of the flexible hose.

4. A container according to claim 3, in which the latch means comprises pairs of clips formed integrally with the body and spaced along the recess, the clips overlapping and bearing on the holster or tube to fix the holster or tube in the recess.

* * * * *